US007093962B2

(12) United States Patent
Mahoney

(10) Patent No.: US 7,093,962 B2
(45) Date of Patent: Aug. 22, 2006

(54) LIGHT EMITTING DEVICE AND METHOD OF USING SAME

(76) Inventor: Michael J. Mahoney, 8905 Versailles Dr., Bakersfield, CA (US) 93311

( * ) Notice: Subject to any disclaimer, the term of this patent is extended or adjusted under 35 U.S.C. 154(b) by 218 days.

(21) Appl. No.: 10/828,995

(22) Filed: Apr. 20, 2004

(65) Prior Publication Data

US 2005/0231961 A1 Oct. 20, 2005

(51) Int. Cl.

| | |
|---|---|
| ***F21S 3/00*** | (2006.01) |
| ***F21V 15/00*** | (2006.01) |
| ***F21V 23/04*** | (2006.01) |
| ***F21L 4/02*** | (2006.01) |

(52) U.S. Cl. ..... 362/363; 362/184; 362/186; 362/230; 362/251; 362/394; 315/209 R; 315/224; 315/294

(58) Field of Classification Search ..... 362/227, 362/249, 251, 363, 809, 184, 186, 230, 394; 473/353, 570; 315/209 R, 224, 294
See application file for complete search history.

(56) References Cited

U.S. PATENT DOCUMENTS

| | | | | |
|---|---|---|---|---|
| 2,903,820 | A | 9/1959 | Bodell | |
| 3,011,048 | A | 11/1961 | O'Brien | |
| 3,304,651 | A | 2/1967 | Deyerl | |
| 3,458,205 | A | 7/1969 | Smith | |
| 3,580,575 | A | 5/1971 | Speeth | |
| 3,610,916 | A * | 10/1971 | Meehan | 362/363 |
| 3,804,411 | A | 4/1974 | Hendry | |
| 3,935,669 | A | 2/1976 | Potrzuski et al. | |
| 4,780,621 | A * | 10/1988 | Bartleucci et al. | 307/11 |
| 4,801,141 | A * | 1/1989 | Rumsey | 84/639 |
| 4,985,813 | A * | 1/1991 | Putman | 362/186 |
| 5,066,011 | A | 11/1991 | Dykstra et al. | |
| 5,313,188 | A | 5/1994 | Choi et al. | |
| 5,670,942 | A * | 9/1997 | Lewis | 340/555 |
| D419,247 | S | 1/2000 | Kessler | |
| 6,079,847 | A * | 6/2000 | Nelson | 362/205 |
| 6,117,030 | A * | 9/2000 | Green, Sr. | 473/570 |
| 6,158,882 | A * | 12/2000 | Bischoff, Jr. | 362/488 |
| 6,428,432 | B1 * | 8/2002 | Kachel | 473/570 |
| 6,717,373 | B1 | 4/2004 | Cash | |
| 2003/0202362 | A1 | 10/2003 | Liou | |
| 2005/0094395 | A1 * | 5/2005 | Rosenberg | 362/249 |

OTHER PUBLICATIONS

Advertising Brochure for PowerFlare, manufactured by PowerFlare Corporation, Copyright 2003 (two-sided document, no author identified).

* cited by examiner

*Primary Examiner*—Sandra O'Shea
*Assistant Examiner*—Jason Han
(74) *Attorney, Agent, or Firm*—James M. Duncan

(57) ABSTRACT

An apparatus and method for strategically illuminating a darkened area. The present invention may be used by law enforcement to illuminate an area without law enforcement officials having to reveal their position, which is the case if flashlights or other lighting means are used. The light emitting device comprises a substantially transparent housing. A circuit comprising light emitting means and battery means is contained within the housing. The circuit further comprises a time delay means, which delays the energizing of the light emitting means. The circuit comprises a switch which, upon activation, closes the circuit providing current from the battery.

62 Claims, 6 Drawing Sheets

LIGHT EMITTING DEVICE AND METHOD OF USING SAME

BACKGROUND OF THE INVENTION

The present invention generally relates to light emitting devices and more specifically to devices and methods which allow a person to illuminate an area without revealing the person's location.

There are times when it is desirable to illuminate a darkened area without revealing a person's location. For example, law enforcement officers may wish to ascertain whether someone is within a darkened area. Conventionally, law enforcement officers would shine a flashlight into the darkened area. However, shining a flashlight immediately betrays the officer's position, making the officer a potential target. Other means of illuminating a darkened area would be to deploy a flare or other light emitting device into the area. However, once again, when the officer deploys such a device into the area, his position is revealed. The present invention addresses this need.

SUMMARY OF THE INVENTION

The present invention is directed to a light emitting device which is deployed into a darkened area to illuminate the area with either visible light or, optionally, with infrared light. While not limited to such use, the present invention may be used by law enforcement to illuminate an area without law enforcement officials having to reveal their position, which is the case if flashlights are used. If infrared lighting means are used, appropriate infrared detection equipment must be used.

The light emitting device comprises a substantially transparent and generally spherical housing. A circuit is contained within the housing, where the circuit is connected to the light emitting means. The circuit comprises light emitting means, a time delay means, which delays the energizing of the light emitting means, and battery means for providing current to the light emitting means. The circuit further comprises a switch which, upon activation, closes the circuit providing current from the battery.

Also disclosed is a method of utilizing the present invention to strategically illuminate a darkened area.

DETAILED DESCRIPTION OF THE EMBODIMENTS

Figure 1:
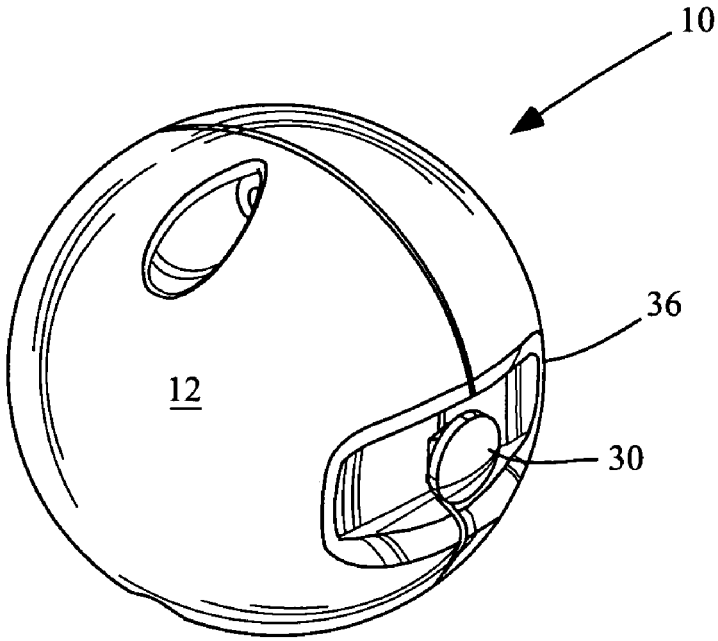
FIG. 1 is a perspective view of a first embodiment of the disclosed invention.
Figure 2:
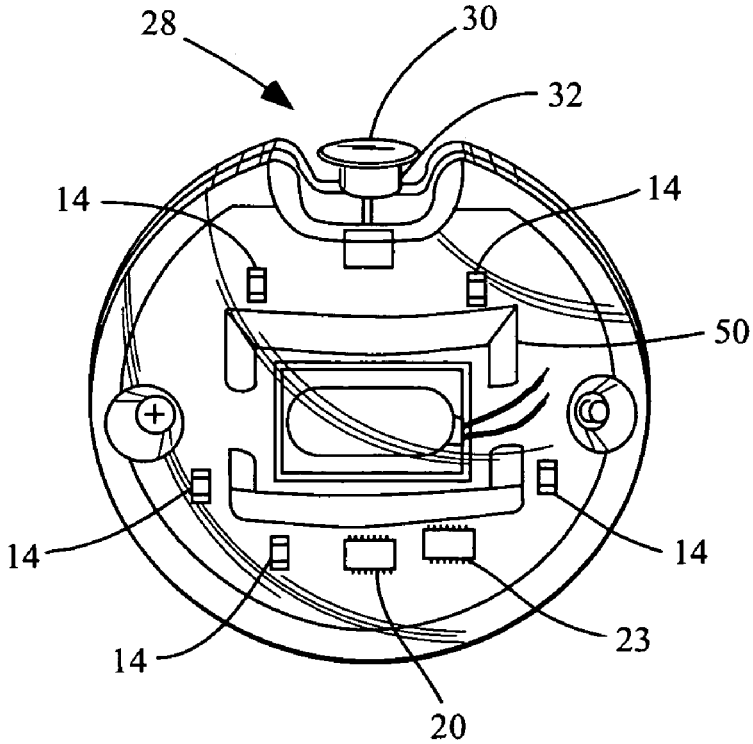
FIG. 2 is a front view of a first embodiment of the disclosed invention.
Figure 3:
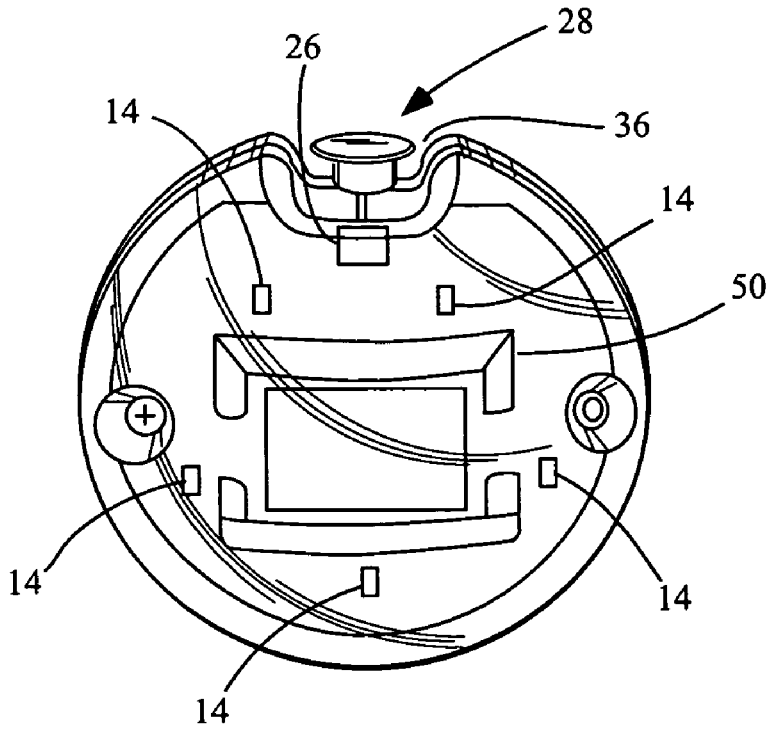
FIG. 3 is a back view of a first embodiment of the disclosed invention.

Referring now specifically to the drawings, FIG. 1 shows a front view of a first embodiment of the disclosed device 10. This embodiment 10 comprises a substantially transparent housing 12 which may be constructed of high impact plastic or other transparent materials such as plexiglass or high strength glass. As shown in FIGS. 1 through 3, the housing 12 may be generally spherical. A light emitting means, such as one or more light emitting diodes 14, are part of a circuit contained within the housing 12. The light emitting diodes 14 may be of such a color, such as red or green, as to preserve the night vision of the users. Alternatively, the light emitting diodes 14 may emit light within the infrared spectrum. Acceptable infrared diodes are available through AGILENT, such as the model HSDL 4420 infrared emitter. With this embodiment, the only persons capable of seeing the illumination would be those equipped with infrared vision devices, such as infrared goggles. In the event the device is used to illuminate an area in which a criminal suspect may be located, the use of infrared diodes would prevent the suspect, not equipped with an infrared vision device, from knowing that he or she has been illuminated.

Figure 10:
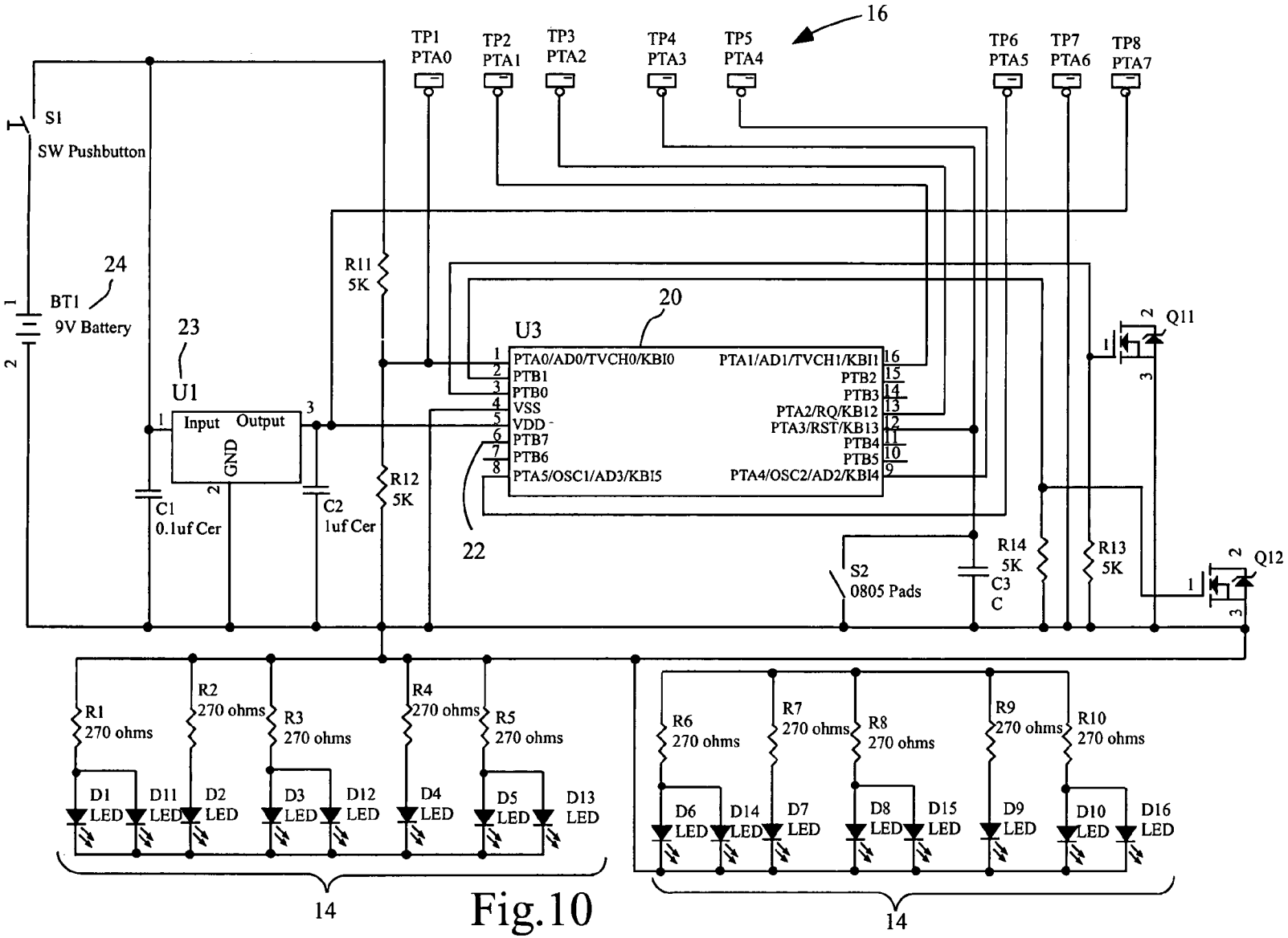
FIG. 10 is a circuit diagram for an embodiment of the invention.

A circuit 16, such as that depicted in FIG. 10, is contained within the housing 12. The circuit comprises the light emitting diodes 14 and time delay means which delays the energizing of the light emitting diodes. The circuit 16 may comprise an integrated circuit, such as microcontroller 20 having a timer. The microcontroller 20 may be packaged as a thin shrink small outline package (TSSOP). The TSSOP may comprise a plurality of leads 22, such as the sixteen leads depicted in FIG. 10. The circuit may also comprise a voltage regulator 23. The microcontroller 20 may be in the Motorola 908Q family. An acceptable microcontroller 20 is a Motorola model MC68HC908QY4CDT having in-circuit re-programmable flash memory. This feature allows the time delay to be readjusted as desired such that the light emitting means, such as the light emitting diodes 14, are energized at a specified time. For example, the time delay might be set at a value of five seconds. However, because of the programmable nature of the microcontroller 20, the time delay may be set at almost any desired value. As shown in FIG. 10, test point numbers 1 through 8 (designated TP1 through TP8) are utilized as communication links between the microcontroller and a programming device, such as a computer, to download or upload a particular program to or from microcontroller 20. As shown in FIG. 10, the circuit further comprises a plurality of resistors.

The light emitting diodes 14 may be divided into a first set of light emitting diodes and a second set of light emitting diodes. For example, the light emitting diodes 14 visible in FIG. 2 may comprise the first set and the light emitting diodes 14 visible in FIG. 3 may comprise the second set. The microcontroller 20 may then be configured so that the first set of light emitting diodes 14 and the second set of light emitting diodes are not energized at the same time, thereby reducing the current drawn by the circuit 16. The frequency of energizing the light emitting diodes 14 may be programmed into microcontroller 20. For example, the first set of light emitting diodes and the second set of light emitting diodes are alternatively energized at 150 cycles per second. At this frequency, it appears that all of the light emitting diodes remain energized, i.e., the blinking of the diodes is not perceptible by the human eye. It is to be appreciated that the frequency of energizing different diodes 14 and the duration of the energized state may be programmed into the microcontroller, resulting in a large number of available combinations. For example, the diodes may be programmed to emit an S-O-S distress call, making the device useful to backpackers, boaters, or others who may be caught in the elements.

The circuit 16 also comprises a battery means, such as battery 24. Battery 24 is also enclosed within housing 12. The battery 24 may be of the nine volt variety, having a positive and negative terminal on the same end. A snap-on connector 25 is connected to the terminals, the lead wires from the connector conductively connected to the other components of circuit 16. The circuit 16 further comprises a switching means, such as microswitch 26, which, upon activation, closes the circuit between the battery 24 and the microcontroller 20, providing current to the various circuit components, such as the microcontroller and light emitting diodes 14. The apparatus may also comprise a switch extension 28 configured to engage microswitch 26. The switch extension 28 may comprise a button 30 and a shaft 32. Because it may be desirable that the device operates silently, the underside of button 30 may comprise insulating member 34, which prevents any clicking caused by the button 30 engaging the housing 12. The exterior of housing 12 may also comprise a recessed section 36, such that a portion of the switch extension 28 extends into the recessed section, allowing the user to engage button 30. Switch extension 28 may be configured such that there is friction fit between shaft 32 and the surrounding housing 12 so that once button 30 is pushed downwardly, thereby activating microswitch 26 and closing circuit 16 until button 30 is pulled upwardly to deactivate the microswitch and open the circuit.

The present device may be deployed by propelling it into a dark environment. If the device is rolled or thrown by the user, the resulting impact or vibration may cause the microswitch 26 to switch to the "off" position. Therefore, one embodiment of the present device includes means for causing switch extension 28 to be retained in a positively locked down position after being depressed in order to maintain the microswitch 26 in an "on" position. The device may be deactivated by pulling upwardly on the switch extension 28.

Figure 8:
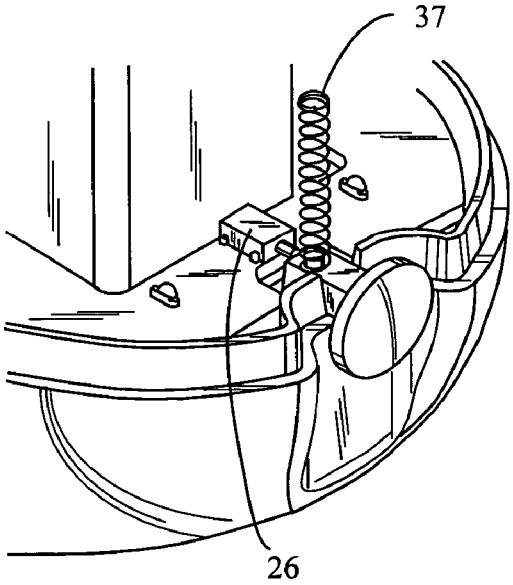
FIG. 8 is a detailed view of a switch assembly for an embodiment of the invention.
Figure 9:
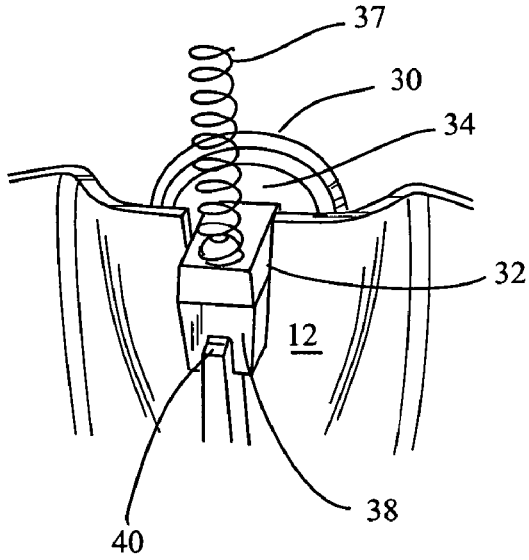
FIG. 9 is a detailed view of a switch assembly for an embodiment of the invention.

FIGS. 8–9 show one means of maintaining the switch extension in a locked position. In this embodiment, a spring 37 may be used to apply a lateral force to shaft 32, which biases a contoured segment 38 of shaft 32 to a matching profile 40 of housing 12, providing a detent to hold the switch extension 28 in a downward position. Spring 37 may be held in position by spring retainer 42, which may be molded on the inside of housing 12.

Figure 4:
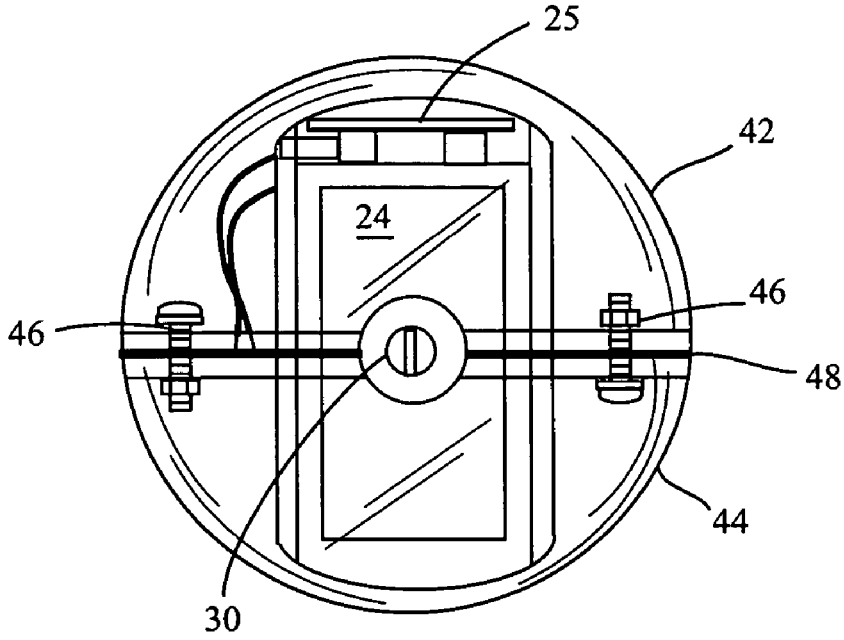
FIG. 4 is top view of a first embodiment of the disclosed invention.
Figure 5:
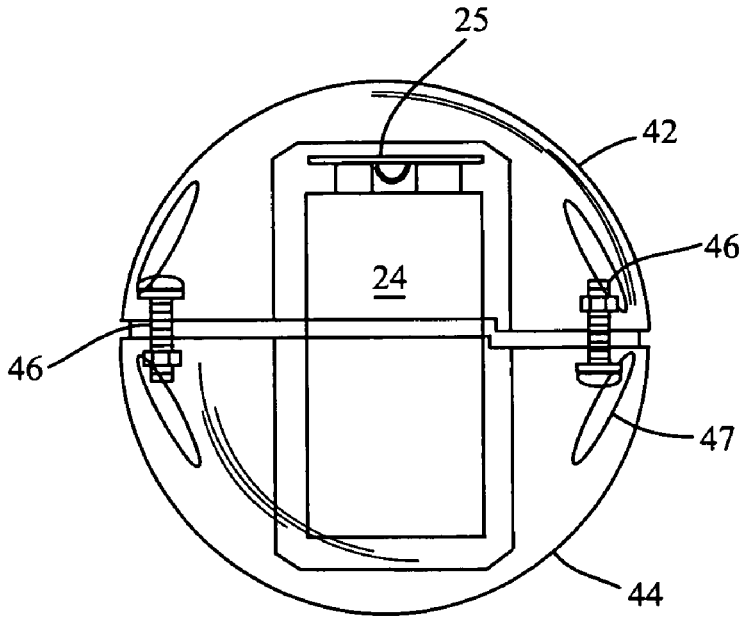
FIG. 5 is bottom view of a first embodiment of the disclosed invention.

As shown in FIG. 4, housing 12 may comprise a first hemisphere 42 and a second hemisphere 44 attached together with fastening means 46. As shown in FIG. 5, the fastening means may be inserted into access ports 47 to maintain the generally spherical configuration of the housing 12. In this configuration, a circuit board 48 may be set between the first hemisphere 42 and the second hemisphere 44. In the first embodiment 10, the first hemisphere 42 and the second hemisphere 44 may be mirror images of another, thereby simplifying the manufacturing process. The circuit board 48 may be configured to contain the circuit 16. In order to change out battery 24, fastening means 46 are released and the two hemispheres separated allowing access to the battery. The circuit board 48 may have a rectangular opening in the approximate mid-section of the circuit board. A battery storage compartment 50 may extend through the rectangular opening in the circuit board 48. A nine volt battery 24 may be disposed within the battery storage compartment 50.

Figure 6:
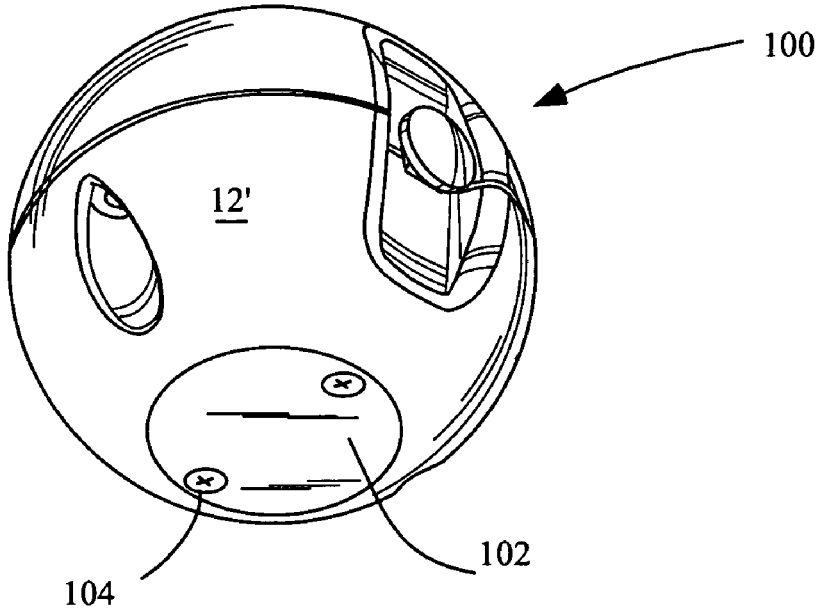
FIG. 6 is a perspective view of a second embodiment of the disclosed invention.
Figure 7:
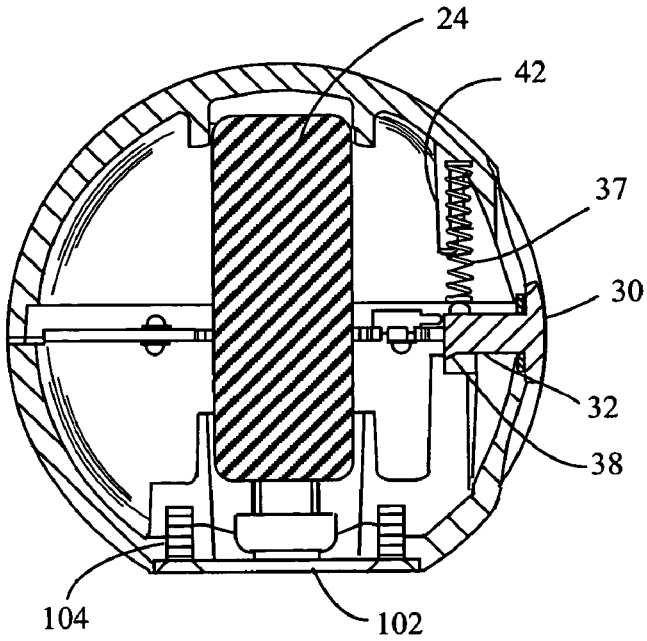
FIG. 7 is a sectional view of the second embodiment.

A second embodiment 100 of the disclosed device is shown in FIG. 6. This embodiment comprises a generally spherical housing 12' having a flat base 102. The base 102 is attached to the housing 12' with fastening means 104. As shown in FIG. 7, access to battery 24 may be gained by removing base 102, allowing the battery to be changed without taking the housing apart as required by the first embodiment 10. Base 102 may comprise a weighted material, such as iron or lead, which is heavier than the plastic generally used for the rest of the housing 12'. The use of weighted material in the base 102 provides a self-righting means which causes the device, following deployment on a surface, to come to a resting position with the flat base 102 engaging the surface. This feature increases the probability that the light emitting diodes 14 will be oriented as desired when the device comes to a resting position.

Figure 11:
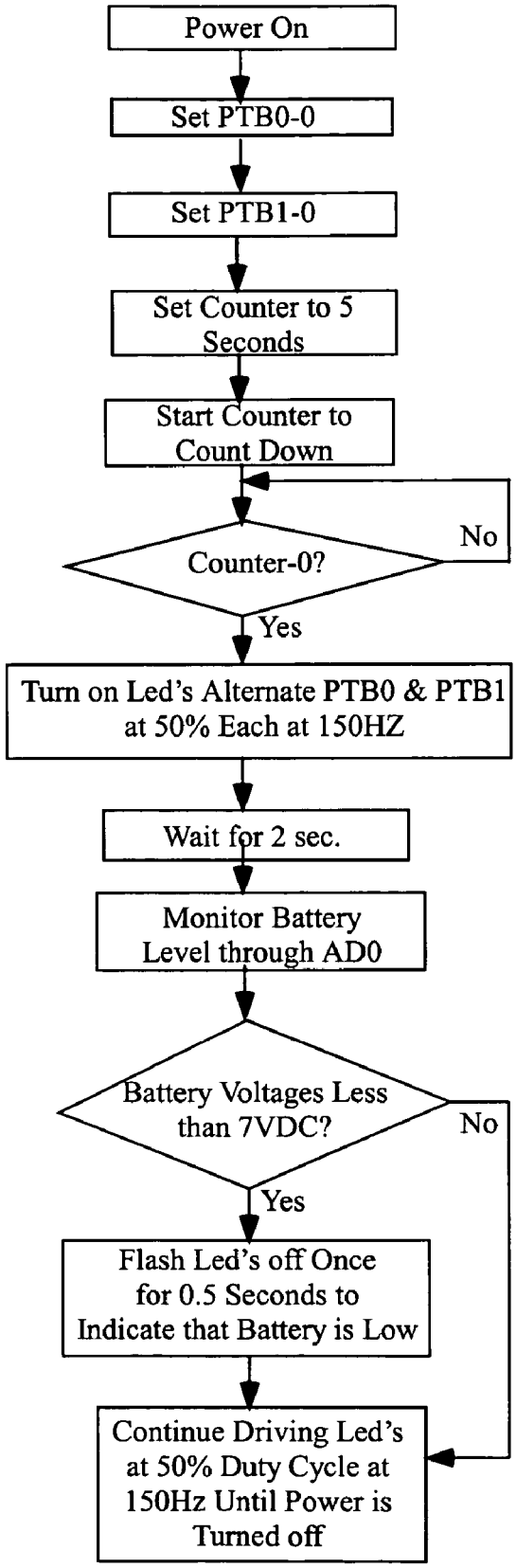
FIG. 11 is a flow chart showing the logic for an embodiment of the invention.

FIG. 11 is a flow diagram showing one variation of how the microcontroller 20 may be programmed for the device. In this program, the light emitting diodes 14 are set into a first set and a second set, with each set energized at a frequency of 150 hertz. This program also checks the battery voltage. If the battery voltage is less than 7 volts dc, the light emitting diodes flash once for 0.5 seconds to indicate that the battery voltage is low.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A light emitting device comprising:

a substantially transparent spherical housing;

a circuit contained within the housing, the circuit comprising a light emitting means, a time delay means, a battery means, means for ascertaining if the voltage of the battery means is less than 7 volts d.c., and a switch which, upon activation, closes the circuit providing current to the circuit from the battery means.

2. The light emitting device of claim 1 wherein the housing is generally spherical having a flat base.

3. The light emitting device of claim 2 wherein the housing contains self-righting means for causing the device, following deployment on a surface, to come to a resting position with the flat base engaging the surface.

4. The light emitting device of claim 1 wherein a switch extension is configured to engage the switch, a portion of the switch extension extending to the exterior of the housing.

5. The light emitting device of claim 4 wherein the exterior of the housing comprises a recessed section, a portion of the switch extension extending into the recessed section.

6. The light emitting device of claim 1 wherein the light emitting means emits light within the infrared spectrum.

7. The light emitting device of claim 1 wherein the housing comprises a first hemisphere and a second hemisphere attached together with fastening means.

8. The light emitting device of claim 7 wherein a circuit board is set between the first hemisphere and the second hemisphere.

9. The light emitting device of claim 8 wherein the light emitting means, the time delay means and the switch are mounted on the circuit board.

10. The light emitting device of claim 1 wherein the time delay means comprises a programmable time delay for energizing of the light emitting means.

11. The light emitting device of claim 1 wherein the light emitting means comprises a first set of light emitting diodes and a second set of light emitting diodes.

12. The light emitting device of claim 11 wherein the circuit is configured so that the first set of light emitting diodes and the second set of light emitting diodes are not energized at the same time.

13. The light emitting device of claim 12 wherein the first set of light emitting diodes and the second set of light emitting diodes are alternatively energized at 150 cycles per second.

14. The light emitting device of claim 1 wherein the battery means comprises a 9 volt dc battery.

15. The light emitting device of claim 1 wherein the circuit further comprises means for temporarily interrupting current flow to all of the light emitting means if the battery voltage is less than 7 volts dc.

16. The light emitting device of claim 1 wherein the circuit comprises a microcontroller.

17. The light emitting device of claim 16 wherein the microcontroller is packaged as a TSSOP.

18. The light emitting device of claim 17 wherein the TSSOP comprises 16 leads.

19. The light emitting device of claim 1 wherein the circuit further comprises a voltage regulator.

20. A light emitting device comprising:

a substantially transparent generally spherical housing, the housing comprising a first hemisphere and a second hemisphere attached together with fastening means;

a round circuit board set between the first hemisphere and the second hemisphere wherein the circuit board has a rectangular opening in the approximate mid-section of the circuit board;

a battery storage compartment contained within the housing;

a circuit comprising a light emitting means, a time delay means, a battery, and a switch which, upon activation, closes the circuit providing current to the circuit from the battery; and the light emitting means, the time delay means and the switch mounted on the circuit board and the battery disposed within the battery storage compartment.

21. The light emitting device of claim 20 wherein the battery storage compartment extends through the rectangular opening in the circuit board.

22. The light emitting device of claim 20 wherein a nine volt battery is disposed within the battery storage compartment.

23. The light emitting device of claim 20 wherein a switch extension is configured to engage the switch, a portion of the switch extension extending to the exterior of the housing.

24. The light emitting device of claim 23 wherein the exterior of the housing comprises a recessed section, a portion of the switch extension extending into the recessed section.

25. The light emitting device of claim 20 wherein the light emitting means comprises a plurality of light emitting diodes.

26. The light emitting device of claim 25 wherein the light emitting diodes emit light within the infrared spectrum.

27. The light emitting device of claim 20 where the time delay means delays energizing of the light emitting means for five seconds.

28. The light emitting device of claim 25 wherein the plurality of light emitting diodes comprises a first set of light emitting diodes and a second set of light emitting diodes.

29. The light emitting device of claim 28 wherein the circuit is configured so that the first set of light emitting diodes and the second set of light emitting diodes are not energized at the same time.

30. The light emitting device of claim 29 wherein the first set of light emitting diodes and the second set of light emitting diodes are alternatively energized at 150 cycles per second.

31. A method of strategically illuminating a darkened area comprising the steps of:

activating a light emitting device having time delay means by engaging a switch on the light emitting device;

deploying the light emitting device by propelling the light emitting device into the darkened area; and waiting for a predetermined time to elapse for the light emitting means to emit light, wherein the light emitting device comprises: (i) a substantially transparent housing and (ii) a circuit contained within the housing, the circuit comprising light emitting means, the time delay means, battery means, means for ascertaining whether the battery means voltage is less than 7 volts dc. and the switch which, upon activation, closes the circuit.

32. The method of claim 31 wherein the housing is generally spherical.

33. The method of claim 31 wherein the housing is generally spherical having a flat base.

34. The method of claim 33 wherein the housing contains self-righting means for causing the device, following deployment on a surface, to come to a resting position with the flat base engaging the surface.

35. The method of claim 31 wherein a switch extension is configured to engage the switch, a portion of the switch extension extending to the exterior of the housing.

36. The method of claim 34 wherein the exterior of the housing comprises a recessed section, a portion of the switch extension extending into the recessed section.

37. The method of claim 31 wherein the light emitting means comprises a plurality of light emitting diodes.

38. The method of claim 37 wherein the light emitting diodes emit light within the infrared spectrum.

39. The method of claim 31 wherein the housing comprises a first hemisphere and a second hemisphere attached together with fastening means.

40. The method of claim 39 wherein a circuit board is set between the first hemisphere and the second hemisphere.

41. The method of claim 40 wherein the light emitting means, the time delay means and the switch are mounted on the circuit board.

42. The method of claim 31 wherein the time delay means delays energizing of the light emitting means for five seconds.

43. The method of claim 37 wherein the plurality of light emitting diodes comprises a first set of light emitting diodes and a second set of light emitting diodes.

44. The method of claim 43 wherein the circuit is configured so that the first set of light emitting diodes and the second set of light emitting diodes are not energized at the same time.

45. The method of claim 44 wherein the first set of light emitting diodes and the second set of light emitting diodes are alternatively energized at 150 cycles per second.

46. The method of claim 31 wherein the battery means comprises a 9 volt dc battery.

47. The light emitting device of claim 46 wherein the circuit further comprises means for temporarily interrupting current flow to all of the light emitting means if the battery voltage is less than 7 volts dc.

48. The method of claim 31 wherein the circuit comprises a microcontroller.

49. The method of claim 48 wherein the microcontroller is packaged as a TSSOP.

50. The method of claim 49 wherein the TSSOP comprises 16 leads.

51. The method of claim 31 wherein the circuit further comprises a voltage regulator.

52. A method of strategically illuminating a darkened area comprising the steps of:

activating a light emitting device having a time delay means by engaging a switch on the light emitting device;

deploying the light emitting device by propelling the light emitting device into the darkened area; and waiting for a predetermined time to elapse for the light emitting device to emit light, wherein the light emitting device comprises: (i) a substantially transparent generally spherical housing, the housing comprising a first hemisphere and a second hemisphere attached together with fastening means; (ii) a circuit contained within the housing, the circuit comprising light emitting means, the time delay means, battery means and the switch which, upon activation, closes the circuit; and (iii) a circuit board disposed between the first hemisphere and the second hemisphere wherein the circuit board has a rectangular opening in the approximate mid-section of the circuit board, the light emitting means, the time delay means and the switch mounted on the circuit board.

53. The method of claim 52 wherein a battery storage compartment extends through the rectangular opening in the circuit board.

54. The method of claim 53 wherein a nine volt battery is disposed within the battery storage compartment.

55. The method of claim 52 wherein a switch extension is configured to engage the switch, a portion of the switch extension extending to the exterior of the housing.

56. The method of claim 55 wherein the exterior of the housing comprises a recessed section, a portion of the switch extension extending into the recessed section.

57. The method of claim 52 wherein the light emitting means comprises a plurality of light emitting diodes.

58. The method of claim 52 wherein the light emitting means emits light within the infrared spectrum.

59. The method of claim 52 wherein the time delay means delays energizing of the light emitting means for five seconds.

60. The method of claim 57 wherein the plurality of light emitting diodes comprises a first set of light emitting diodes and a second set of light emitting diodes.

61. The method of claim 60 wherein the circuit is configured so that the first set of light emitting diodes and the second set of light emitting diodes are not energized at the same time.

62. The method of claim 61 wherein the first set of light emitting diodes and the second set of light emitting diodes are alternatively energized at 150 cycles per second.

* * * * *